United States Patent [19]

Kadokawa

[11] Patent Number: 5,054,440

[45] Date of Patent: Oct. 8, 1991

[54] CAM FOLLOWER DEVICE FOR VALVE DRIVING MECHANISM IN ENGINE

[75] Inventor: Satoshi Kadokawa, Kanagawa, Japan

[73] Assignee: Nippon Seiko Kabushiki Kaisha, Tokyo, Japan

[21] Appl. No.: 543,645

[22] Filed: Jun. 26, 1990

[30] Foreign Application Priority Data

Jun. 29, 1989 [JP] Japan ..... 1-165365

[51] Int. Cl.[5] ..... F01L 1/18

[52] U.S. Cl. ..... 123/90.5; 123/90.51; 123/90.39; 74/519; 74/559

[58] Field of Search ..... 123/90.39, 90.44, 90.48, 123/90.5, 90.51; 74/519, 559

[56] References Cited

U.S. PATENT DOCUMENTS

| | | | |
|---|---|---|---|
| 4,607,599 | 8/1986 | Buente et al. | 123/90.5 |
| 4,628,874 | 12/1986 | Barlow | 123/90.51 |
| 4,727,832 | 3/1988 | Miyamura et al. | 123/90.5 |
| 4,768,476 | 9/1988 | Behnke et al. | 123/90.51 |
| 4,872,429 | 10/1989 | Anderson et al. | 123/90.51 |

FOREIGN PATENT DOCUMENTS

| | | |
|---|---|---|
| 180156 | 11/1983 | Japan . |
| 159805 | 10/1985 | Japan . |
| 7908 | 1/1987 | Japan . |
| 203911 | 12/1987 | Japan . |
| 294706 | 12/1987 | Japan . |
| 42805 | 3/1988 | Japan . |
| 113108 | 5/1988 | Japan . |
| 34406 | 3/1989 | Japan . |
| 78206 | 5/1989 | Japan . |
| 142206 | 6/1989 | Japan . |

*Primary Examiner*—David A. Okonsky
*Assistant Examiner*—Weilun Lo
*Attorney, Agent, or Firm*—Caesar, Rivise, Bernstein, Cohen & Pokotilow, Ltd.

[57] ABSTRACT

A cam follower device which is incorporated in a valve driving mechanism for an engine to contact the outer peripheral surface of a cam secured to a cam shaft that rotates synchronously with a crankshaft of the engine, thereby transmitting the motion of the cam to a valve that opens and closes a suction port or an exhaust port in the enigne. A ring-shaped member which contacts the cam is formed from a ceramic material, and this ceramic ring-shaped member is rotatably supported around a steel shaft. The clearance between the inner peripheral surface of the ceramic ring-shaped member and the steel shaft is set within a specific range, thereby preventing the occurrence of problems, for example, noise, arising due to a difference in thermal expansion coefficient between the two members and thus improving the high-speed follow-up performance of the cam follower device.

15 Claims, 5 Drawing Sheets

CAM FOLLOWER DEVICE FOR VALVE DRIVING MECHANISM IN ENGINE

BACKGROUND OF THE INVENTION

1. Field of the Invention

The present invention relates to a cam follower device which is incorporated in a valve driving mechanism in an engine used to run, for example, an automobile, to reduce the friction occurring in the valve driving mechanism, thereby achieving a reduction in output loss during the running of the engine. More particularly, the present invention pertains to a cam follower device for a valve driving mechanism in an engine, which is designed to achieve improvements in the performance of the engine, particularly an increase in engine speed.

2. Description of the Prior Art

Among various types of engine which are used to run, for example, automobiles, reciprocating engines are all provided with a pair of suction and exhaust valves which are opened and closed synchronously with the rotation of a crankshaft, except for two-cycle engines.

There are various types of valve driving mechanisms for driving the suction and exhaust valves. For example, in an SOHC type valve driving mechanism, which is shown in FIG. 12, a suction valve 4 and an exhaust valve 5 are driven to reciprocate through respective rocker arms 3 by a single cam shaft 2 that rotates at a speed which is half the speed of a crankshaft 1 (in the case of a four-cycle engine). Cams 6 which are rigidly secured to the cam shaft 2 that rotates synchronously with the crankshaft 1, rotate in slide contact with the respective end portions of the rocker arms 3, thereby reciprocatively driving the suction valve 4 and the exhaust valve 5.

Incidentally, it has recently been proposed to provide cam follower devices, which rotate in response to the rotation of the cams 6, in between the cams 6 and the mating rocker arms 3, respectively, to reduce the friction occurring between the peripheral surfaces of the cams 6 and the contact portions of the rocker arms 3 during the running of the engine, thereby achieving a reduction in output loss, and thus improving the engine's efficiency, as disclosed, for example, in Japanese Utility Model Public Disclosure (KOKAI) No. 64-34406 (1989).

More specifically, a cam follower device which is incorporated in an engine for this purpose, is arranged as shown in FIGS. 13 and 14. A pair of spaced support wall portions 7 are provided at the end portion of a rocker arm 3 that faces a cam 6, and two end portions of a shaft 8 are fitted into respective through-holes 11 which are formed in the support wall portions 7, thereby securing the shaft 8 between the pair of support wall portions 7. An outer ring 10, which is in the form of a short cylinder, is provided around the shaft 8 through needle bearings 9. The outer peripheral surfaces of the outer ring 10 and the cam 6 are brought into contact with each other so that the outer ring 10 rotates about the shaft 8 in response to the rotation of the cam 6.

By providing such a rotatable outer ring 10 to change the friction occurring between the cam 6 and a member mated therewith from sliding friction to rolling friction, the output loss during the running of the engine is lowered and fuel consumption decreases, so that the engine efficiency is improved.

There has been another prior art wherein part of the above-described cam follower device is formed from a ceramic material with a view to reducing the overall weight of the cam follower device and improving the high-speed follow-up performance, and thus being suitable in line with the recent tendency for the rotational speed of engines to be increased, as disclosed in Japanese Patent Public Disclosure (KOKAI) No. 63-113108 (1988) and Japanese Utility Model Public Disclosure (KOKAI) Nos. 60-159805 (1985), 62-203911 (1987) and 63-42805 (1988).

Among the conventional cam follower devices of this type, the one disclosed in Japanese Patent Public Disclosure (KOKAI) No. 61-113108 is arranged as shown in FIGS. 15 and 16.

More specifically, a bush 12 which is made of a ceramic material is rotatably fitted around the shaft 8 that is provided between the support wall portions 7 formed at the end of the rocker arm 3, and an outer ring 13 which is similarly made of a ceramic material is fitted around the bush 12 in such a manner that the outer ring 13 is rotatable relative to the bush 12.

In the case of the cam follower device disclosed in Japanese Patent Public Disclosure (KOKAI) No. 63-113108, the ceramic bush 12 is provided between the inner peripheral surface of the ceramic outer ring 13 and the outer peripheral surface of the shaft 8, which is made of steel, thereby lowering the relative sliding velocity between the outer peripheral surface of the steel shaft 8 and the inner peripheral surface of the ceramic bush 12 (in contrast to the arrangement where the outer ring 13 is fitted directly onto the shaft 8), and thus reducing output loss and preventing wear of the outer peripheral surface of the steel shaft 8.

However, a conventional cam follower device for a valve driving mechanism in an engine, such as that disclosed in the above-described Japanese Patent Public Disclosure (KOKAI) No. 63-113108, does not always perform satisfactorily.

More specifically, although the relative velocity between the inner peripheral surface of the bush 12 and the outer peripheral surface of the shaft 8 is lower than in the case where the outer ring 13 is fitted directly onto the shaft 8, it is still impossible to avoid the occurrence of friction therebetween, and no satisfactory reduction in output loss can be achieved. In addition, it is necessary in order to prevent wear of the shaft 8 made of steel, which is softer than a ceramic material, to supply sufficient lubricating oil to a very small clearance that is present between the two peripheral surfaces. The necessary lubrication mechanism accordingly becomes complicated.

On the other hand, Japanese Patent Public Disclosure No. 01-142206 (1989) discloses a cam follower device for an engine, which comprises an outer ring at least the outer surface of which is formed from a ceramic material, a shaft for the outer ring, and a plurality of needle bearings which are interposed between the outer ring and the shaft. By interposing needle bearings between the outer ring and the shaft therefor, it is possible to reduce output loss during the running of the engine and retain an adequate amount of lubricating oil in the area between each pair of adjacent needle bearings. Accordingly, it is possible to effectively lubricate the area between the inner peripheral surface of the outer ring and the outer peripheral surface of the shaft, where the needle bearings are provided.

Although not mentioned in the above-described Japanese Patent Public Disclosure (KOKAI) No. 01-142206, there are many restrictions in practice on the selection of a part of the cam follower device which is to be replaced with a ceramic material. In addition, if a part of the cam follower device is replaced with a ceramic material, very difficult problems arise in combination with other parts which are made of steel.

For example, if one or all of the parts, i.e., the shaft 15, the outer ring 14 and the needle bearings 16, in the structure shown in FIGS. 17 and 18, are made of a ceramic material, it is possible to reduce the inertial mass of the cam follower device correspondingly to the number of parts made of a ceramic material and the mass of these parts and hence cope with the increase in engine speed. However, when the parts 15, 14 and 16 are merely formed from a ceramic material, the following problems arise:

First, when the shaft 15 is made of a ceramic material, if the support wall portions 7 made of either aluminum, which is relatively soft, or a steel, which is plastically deformable, are subjected to staking to secure the shaft 15, the support wall portions 7 cannot bite into the ceramic shaft 15 because it is not plastically deformable. Thus, the support wall portions 7 cannot be effectively staked, and it is therefore difficult to firmly secure the shaft 15 to the support wall portions 7. Accordingly, it has been considered to form the shaft 15 from a steel material so that the end portions of the shaft 15 are plastically deformable, with a view to firmly securing the shaft 15. In this case, the mass increases a little, but the increase in the mass can be minimized, for example, by forming the shaft 15 in a hollow structure. When the needle bearings 16 are made of a ceramic material, the production of the needle bearings 16 becomes difficult, so that the production cost of the cam follower device becomes significantly higher. Since the needle bearings 16 are thin and even the total volume thereof is not large, even if the constitutent material of the needle bearings 16 is changed from a steel material to a ceramic material, the reduction in the weight that is brought about by the change of constituent materials is not large, so that no significant improvement in the high-speed follow-up performance of the cam follower device can be expected. It is therefore preferable to form the needle bearings 16 from a steel material. Under the above-described circumstances, it is concluded that a practically effective way is to form only the outer ring 14 from a ceramic material.

However, the following problems newly arise due to the difference in thermal expansion between the outer ring 14 made of a ceramic material, which has a relatively small coefficient of thermal expansion, and the shaft 15 and the needle bearings 16, which are made of a steel material having a relatively large coefficient of thermal expansion:

When the engine is at rest, the cam follower device is at an ordinary temperature (e.g., 20° C.), whereas, when the engine is in an operative state, the temperature of the cam follower device rises to about 120° C. The thermal expansion of the shaft 15 and the needle bearings 16 that is caused by the rise in the temperature is greater than that of the outer ring 14 made of a ceramic material.

Accordingly, when the temperature of the cam follower device rises as the engine is run, the size of the clearance that is present where the steel needle bearings 16 are disposed, that is, the dimension h that is determined by subtracting the sum of the outer diameter D of the shaft 15 and double the outer diameter d of a needle bearing 16 from the inner diameter R of the outer ring 14, i.e., $h=R-(D+2d)$, decreases. If the clearance h becomes excessively small on such an occasion, the needle bearings 16 may seize. In an extreme case, the ceramic outer ring 14 may be cracked by being forcibly extended outwardly.

If the clearance h at ordinary temperature is set at an excessively large value with a view to preventing the seizure of the needle bearings 16 and possible cracking of the outer ring 14, the level of noise generated from the cam follower device becomes excessively high during the initial running stage of the automotive engine when the temperature of the cam follower device is still low and, in an extreme case even when the temperature of the engine has risen.

SUMMARY OF THE INVENTION

In view of the above-described problems of the prior art, it is an object of the present invention to provide a cam follower device for a valve driving mechanism in an engine, which is designed so as to reduce friction, enable effective and easy lubrication, permit easy and reliable securing of the shaft, lower the noise level, eliminate the fear of seizure or cracking, and improve the high-speed follow-up performance.

The cam follower device of the present invention is incorporated in a valve driving mechanism of an engine to contact the outer peripheral surface of a cam secured to a cam shaft that rotates synchronously with a crankshaft of the engine, thereby transmitting the motion of the cam to a valve that opens and closes a suction port or an exhaust port in the engine.

The cam follower device of the present invention comprises: a pair of spaced support wall portions which are formed on a member that is provided in opposing relation to the cam to receive the motion of the cam; through-holes which are formed in the support wall portions at respective positions that are aligned with each other; a steel shaft which has been hardened at an intermediate portion thereof, two end portions of the shaft, which are not hardened, being fitted into the through-holes and then staked toward the inner peripheral surfaces of the through-holes where the end portions are disposed, thereby being secured between the pair of support wall portions; and a ceramic outer ring which is rotatably supported through a plurality of hardened steel needle bearings around the intermediate portion of the shaft that is located in between the pair of support wall portions, the outer ring being in contact at the outer peripheral surface with the outer peripheral surface of the cam.

In addition, the clearance gap which is present where the steel needle bearings are disposed at an ordinary temperature is set within the range of from ($5\ \mu m+9.5\times10^{-4}$ Di) to ($18\ \mu m+9.5\times10^{-4}$ Di), where Di is the inner diameter of the outer ring.

In the cam follower device of the present invention that is arranged as described above, the power transmitting function per se that is performed between the cam and the cam follower is the same as in the case of the conventional cam follower device that is disclosed, for example, in the above-described Japanese Utility Model Public Disclosure (KOKAI) No. 64-34406 (1989). That is, when the engine is running, the outer ring rotates around the shaft, and while doing so, it transmits the motion of the cam to the member that is provided in opposing relation to the cam. Since this transmission is performed on the basis of the rolling of the needle bearings that are provided between the outer ring and the shaft, the output loss due to friction is small, so that the engine efficiency improves.

The outer ring rotates around the shaft in response to the rolling of the plurality of needles. Lubrication of these needle bearings can be readily and surely effected by means of a lubricating oil that is retained in the area between each pair of adjacent needle bearings.

In the cam follower device according to the present invention, only the outer ring is formed from a ceramic material and the shaft is formed from a steel material which has been hardened only at the intermediate portion. Accordingly, the steel shaft can be reliably secured by staking the two end portions, which are not hardened, so that these end portions bite into the support wall portions while deforming the latter. In addition, since the outer ring, which has a relatively large volume, is formed from a ceramic material, the inertial mass of the cam follower device decreases. As a result, the high-speed follow-up performance of the cam follower device improves, and it becomes easy to cope with an increase in engine speed. In addition, the force with which the outer ring presses the needle bearings when performing high-speed reciprocating motion decreases, so that the lifetime of the needle bearings is lengthened.

Since the clearance gap which is present where the steel needle bearings are disposed at ordinary temperature is set within the range of from ($5\ \mu m+9.5\times10^{-4}$ Di) to ($18\ \mu m+9.5\times10^{-4}$ Di), where Di is the inner diameter of the outer ring, it is possible to maintain a low level of noise over the whole engine operation, i.e., from the time when the engine has been just started to the time when the temperature of the engine has risen generated by the cam follower device, while preventing any seizure of the needle bearings and cracking of the outer ring.

BRIEF DESCRIPTION OF THE DRAWINGS

FIGS. 1 and 2 show one embodiment of the cam follower device according to the present invention, in which FIG. 1 is equivalent to a sectional view taken along the A—A of FIG. 14, and FIG. 2 is a sectional view taken along the line B—B of FIG. 1;

FIGS. 8 to 11 show another example of the staking of the shaft end portion, in which FIG. 8 is an end view of a jig that is used for the staking process, FIG. 9 is a sectional view taken along the line C—C of FIG. 8, FIG. 10 is a side view showing the staked configuration of the shaft end portion, and FIG. 11 is a sectional view taken along the line D—D of FIG. 10;

DESCRIPTION OF THE PREFERRED EMBODIMENT

One embodiment of the present invention will be described below in more detail with reference to the accompanying drawings.

Figure 1:
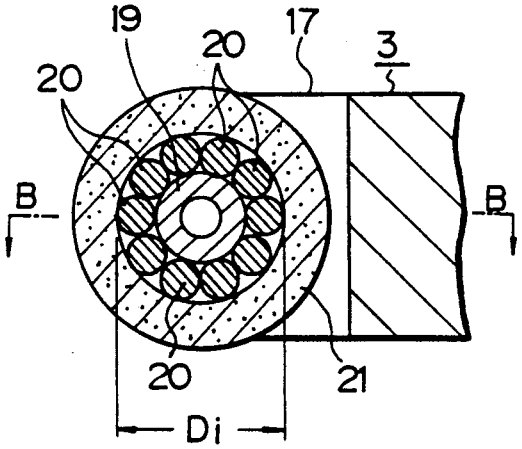
Figure 2:
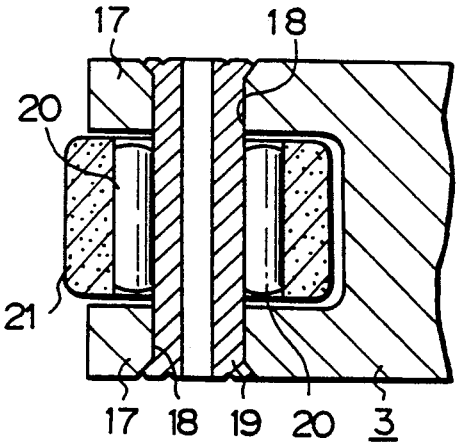
Figure 12:
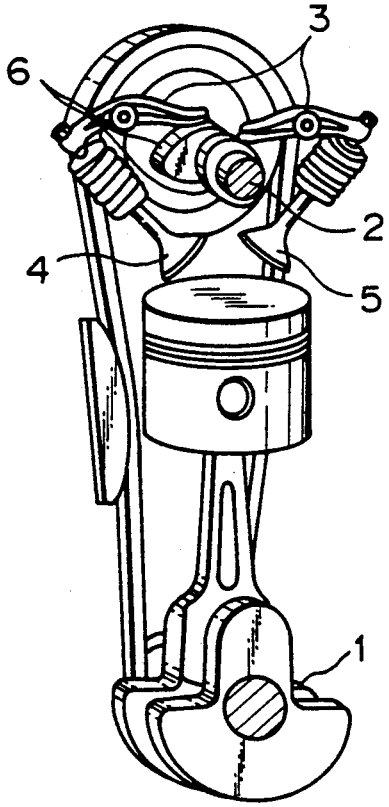
FIG. 12 is a perspective view showing one example of an engine which incorporates the cam follower device of the present invention.
Figure 13:
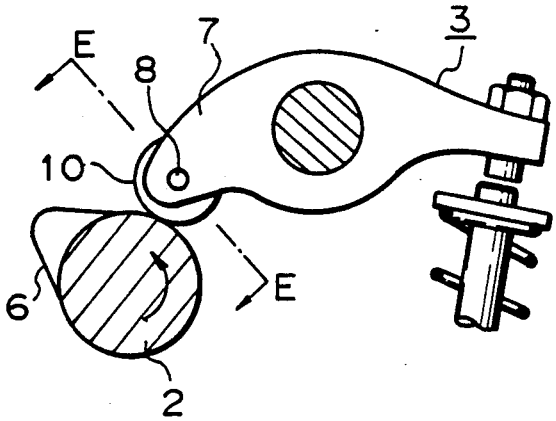
FIG. 13 is a side view of a cam follower device which is assembled to a rocker arm.
Figure 14:
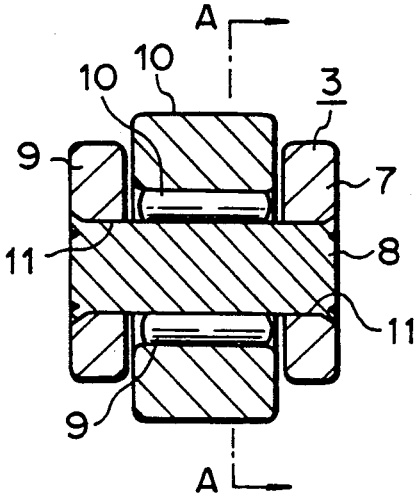
FIG. 14 is a sectional view taken along the line E—E of FIG. 13.
Figure 15:
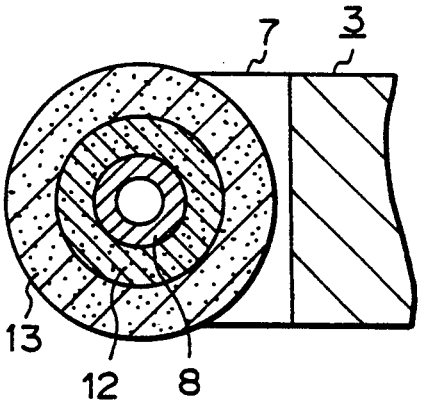
FIGS. 15 and 16, which are similar to FIGS. 1 and 2, show one example of conventional cam follower devices.
Figure 16:
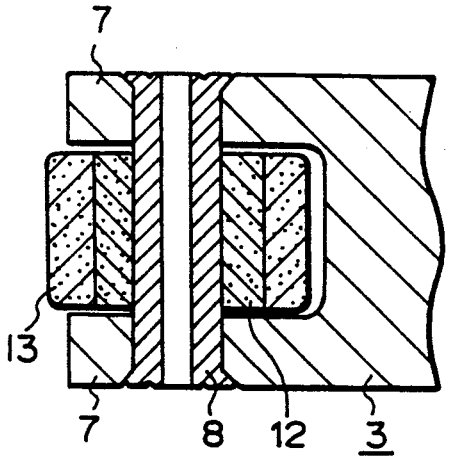
Figure 17:
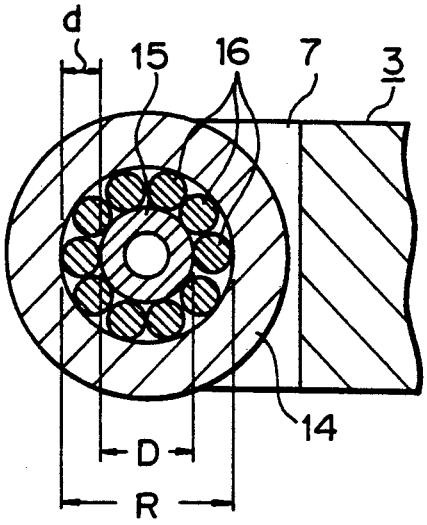
FIGS. 17 and 18, which are similar to FIGS. 1 and 2, show another example of conventional cam follower devices.
Figure 18:
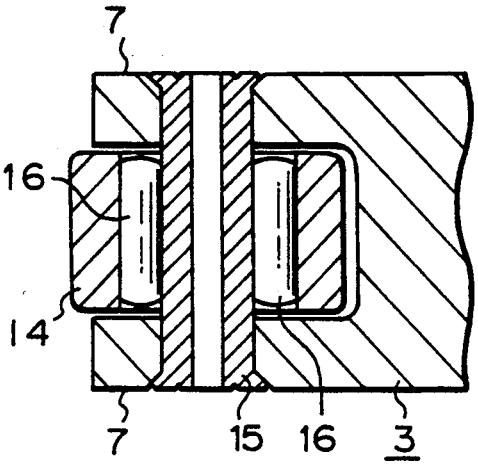

As shown in FIGS. 12 and 13, cams 6 are secured to a cam shaft 2 which rotates synchronously with the crankshaft of an engine, and a rocker arm 3 is provided in opposing relation to each of the cams 6 to receive the motion of the cam 6, the rocker arm 3 being made of aluminum or steel. Referring to FIGS. 1 and 2, a pair of spaced support wall portions 17 are provided at an end portion of the rocker arm 3. The central portions of the support wall portions 17 are provided with circular through-holes 18 at respective positions which are aligned with each other.

The through-holes 18 are fitted with two end portions of a shaft 19 which is formed from a bearing steel in the shape of a hollow tube, and the two end portions of the shaft 19 are staked toward the inner peripheral surfaces of the through-holes 18 where these end portions are disposed, thereby plastically deforming the inner peripheral surfaces of the through-holes 18, and thus securing the shaft 19 extending between the pair of support wall portions 17.

It should be noted that the intermediate portion of the shaft 19 that is located between the pair of support wall portions 17 has been hardened by a conventional hardening method, for example, induction hardening, cementation, etc., so that the surface hardness of the hardened portion is in the range of from Hv 640 to Hv 840, with a view to preventing the outer peripheral surface of the intermediate portion of the shaft 19, which is in contact with needle bearings 20 (described later), from becoming worn or damaged. The two end portions of the shaft 19 are not hardened so that the hardness thereof is in the range of from Hv 200 to Hv 336, thereby enabling these end portions to be staked when the shaft 19 is secured to the support wall portions 17.

Figure 8:
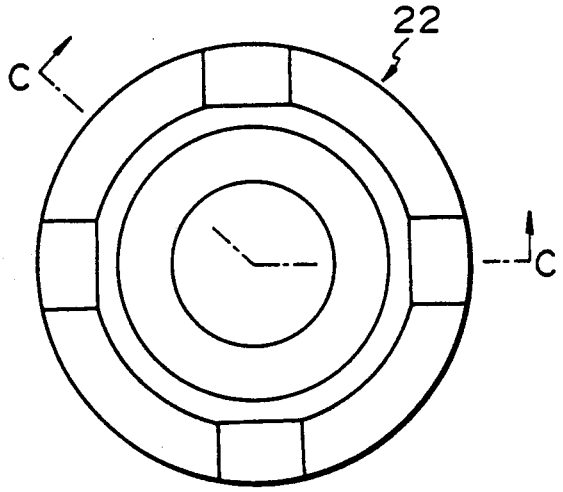
Figure 9:
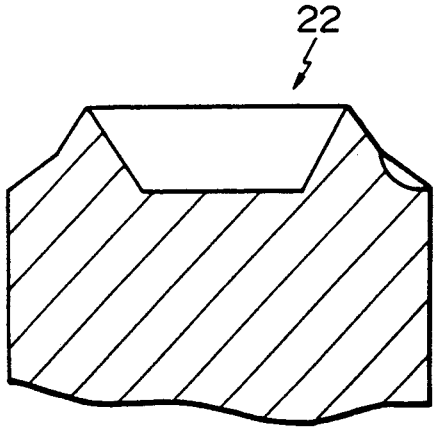
Figure 10:
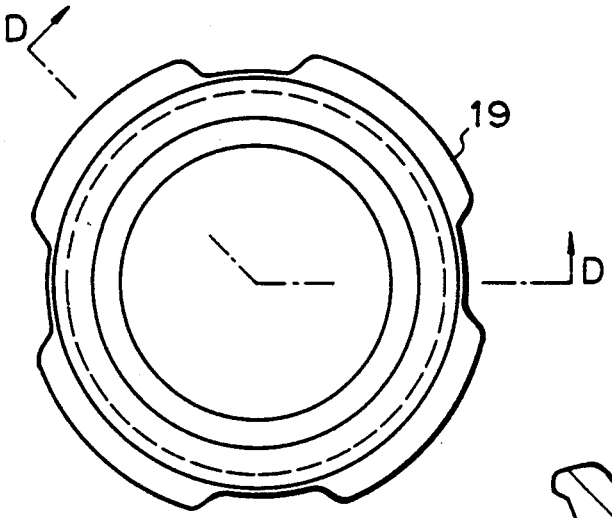
Figure 11:
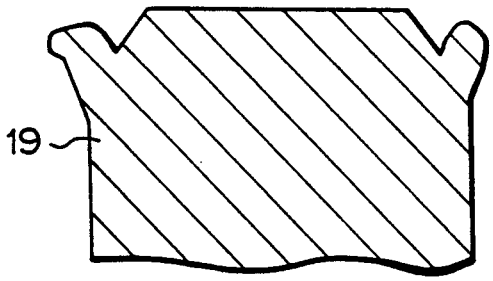

The two end portions of the shaft 19 are staked in such a manner that the staked portions are non-concentrical with respect to the through-holes 18 (see the above-described Japanese Utility Model Public Disclosure (KOKAI) No. 64-34406), as shown in FIGS. 4 to 7, or each end portion of the shaft 19 is staked as shown in FIGS. 10 and 11 by pressing a jig 22, shown in FIGS. 8 and 9, against the end face of the shaft 19, thus preventing the shaft 19 from rotating within the through-holes 18 formed in the support wall portions 17.

A ceramic outer ring 21 is rotatably supported through a plurality of steel needle bearings 20 around the intermediate portion of the shaft 19 which extends between the pair of support wall portions 17 and which is secured at two end portions thereof by these support wall portions 17, as described above. The outer ring 21 is formed from a ceramic material, for example, silicon nitride ($Si_3N_4$), which has a hardness of not less than Hv 1000 and a specific gravity of not more than 4. The needle bearings 20 are formed from a bearing steel having a surface hardness of about Hv 900.

The size of a clearance which is present where the steel needle bearings 20 are disposed at ordinary temperature is set within the range of from ($5\ \mu m + 9.5 \times 10^{-4}$ Di) to ($18\ \mu m + 9.5 \times 10^{-4}$ Di), where Di is the inner diameter of the outer ring 21.

The reason for setting the clearance within the above-described range is as follows.

Figure 3:
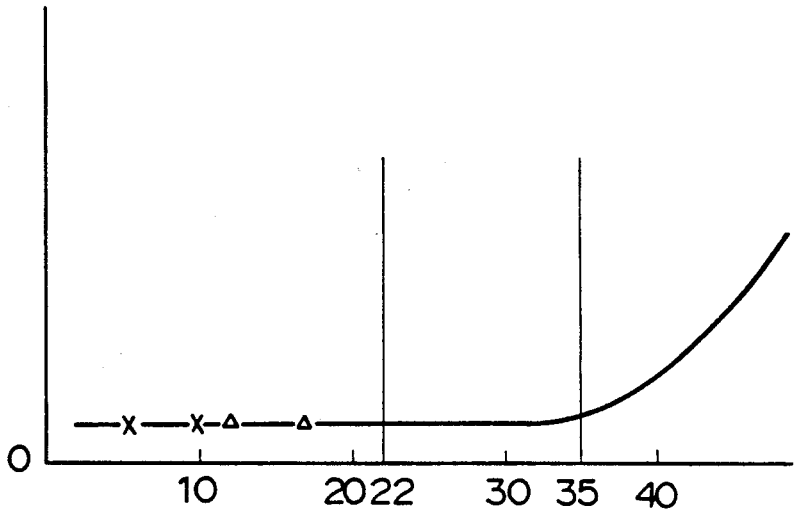
FIG. 3 is a graph showing the relationship between the size of the clearance that is present where the steel needle bearings are disposed at ordinary temperature and the level of noise generated by the cam follower device in one example in which the inner diameter of the outer ring is 18 mm.
Figure 4:
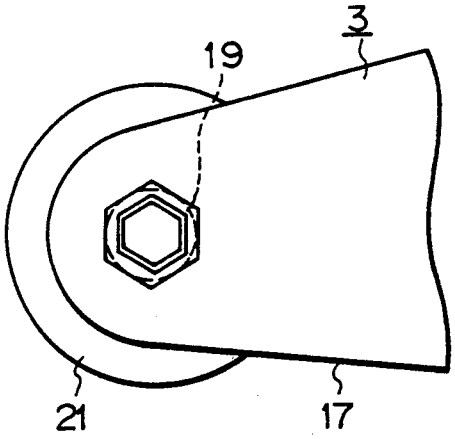
FIGS. 4 to 7 are side views showing four examples of the staked configuration of the shaft end portion.
Figure 5:
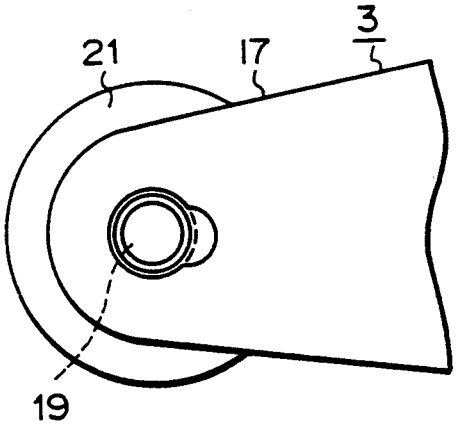
Figure 6:
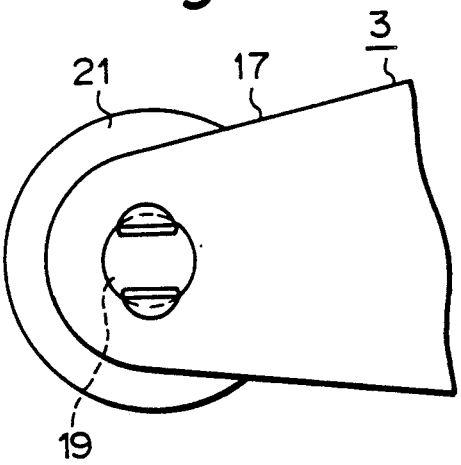
Figure 7:
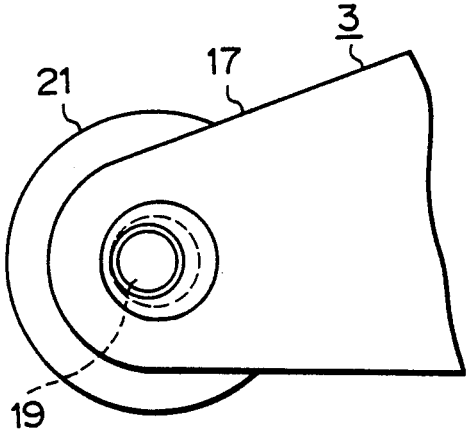

An experiment carried out by the present inventor confirms that, when the inner diameter Di of the outer ring 21 is 18.0 mm, the relationship between the above-described clearance h at ordinary temperature and the noise that is generated by the cam follower device is such as that shown in FIG. 3; as will be clear from the graph, the level of noise generated during the rotation of the outer ring 21 rises when the clearance h exceeds 35 μm. In some of the samples having a clearance of 17 μm or less, indicated by the mark Δ in the figure, the needle bearings 20 (see FIGS. 1 and 2) seized during the rotation of the outer ring 14. In some of the samples having a clearance of 10 μm or less, indicated by the mark x, the ceramic outer ring 21 (see FIGS. 1 and 2) cracked as the temperature of the cam follower device rose.

In actual use of the cam follower device in an engine, the seizure of the needle bearings 20 and the cracking of the outer ring 14 must be prevented and it is therefore necessary to leave a surplus of about 5 μm when setting a lower-limit value for the clearance h, with the machining accuracy being taken into consideration. It will therefore be understood from the experimental results shown in FIG. 3 that the suitable range of the clearance h at ordinary temperature is from 22 μm to 35 μm.

The experimental results shown in FIG. 3 are what were obtained in regard to the outer ring 21 having an inner diameter Di of 18 mm. To enable the range (from 22 μm to 35 μm) of the proper clearance h at ordinary temperature to apply to cam follower outer rings having an inner diameter Di of from 10 mm to 18 mm, which are used for ordinary automotive engines, an expression of from $[5+(\alpha_1-\alpha_2)\cdot\Delta t\cdot Di]$ to $[18+(\alpha_1-\alpha_2)\cdot\Delta t\cdot Di]$ is deduced from the above-described experimental results with the following factors being taken into consideration: the difference between the coefficient of linear thermal expansion $\alpha_1$ of a bearing steel used to form the shaft 19 and the needle bearings 20 and the coefficient of linear thermal expansion $\alpha_2$ of a ceramic material used to form the outer ring 21, and the rise Δt in temperature of the cam follower device during the running of the engine. On the basis of this expression, the above-described range of the clearance h that is present where the steel needle bearings 20 are disposed at ordinary temperature, i.e., from ($5\ \mu m + 9.5 \times 10^{-4}$ Di) to ($18\ \mu m + 9.5 \times 10^{-4}$ Di), is determined.

In the cam follower device of the present invention that is arranged as described above, the power transmitting function per se that is performed between the cam and the cam follower is the same as in the case of the conventional cam follower device described above.

More specifically, the rotatable outer ring 21 is provided around the shaft 19 that is secured to the distal end portion of the rocker arm 3 to change the friction occurring between the rocker arm 3 and the cam 6 (see FIGS. 12 and 13), which rotates synchronously with the crankshaft 2 of the engine, from the sliding friction to the rolling friction, thereby enabling a reduction in output loss and an improvement in the engine efficiency.

If, in the foregoing arrangement, the outer peripheral surface of the outer ring 21 is subjected to crowning (i.e., if each edge portion of the outer peripheral surface of the outer ring 21 is formed into a curved surface where the diameter gradually decreases toward the edge), the contact between the outer peripheral surfaces of the cam 6 and the outer ring 21 is made uniform, so that the wear of the cam 6, which is made of steel, can be reduced furthermore.

In the cam follower device of the present invention, wherein the engine efficiency is improved by a reduction in the power loss, since the outer ring 21 is formed from a ceramic material, which has a relatively small specific gravity (i.e., the specific gravity of a typical bearing steel is about 7.83, whereas the specific gravity of the above-described silicon nitride ceramic material is 4.0 or less), the inertial mass of the cam follower device decreases. In consequence, the high-speed follow-up performance of the cam follower device is improved, and it becomes easy to cope with an increase in engine speed. In addition, since the load on the needle bearings 20 decreases in accordance with the acceleration that acts on the outer ring 21, the lifetime of the needle bearings 20 can be lengthened.

Since the steel shaft 15 is secured to the steel or aluminum support wall portions 17, the two end portions of the shaft 15 and the support wall portions 17 are engaged deeply with each other. Thus, the shaft 15 can be firmly secured so that it will not rotate.

In addition, since the clearance h that is present where the steel needle bearings 20 are disposed at ordinary temperature is set within a proper range, it is possible to prevent seizure of the needle bearings 20 and cracking of the outer ring 21 irrespective of the rise in temperature during the running of the engine. Moreover, the noise that is generated by the cam follower device can be maintained at a low level at all times independently of a temperature change which occurs when the engine is started or stopped.

Although in the foregoing embodiment the cam follower device is provided at the end portion of the rocker arm 3, in the case of a DOHC engine it may be provided at the proximal end portion of the associated valve or at the intermediate portion of the rocker arm 3, as disclosed in the above-described Japanese Utility Model Public Disclosure (KOKAI) No. 64-34406.

When the cam follower device is attached to an aluminum rocker arm, an annular plate member may be provided in between each end of the needle bearings 20 and the inner side surface of each of the pair of support wall portions 17 that are provided on a part of the aluminum rocker arm, to prevent wear of the inner side surfaces of the aluminum support wall portions 17, which would otherwise be caused by direct contact with the needle bearings 20, which are made of a bearing steel.

Such an annular plate member may be attached to the inner side surface of each of the support wall portions 17, or supported at the inner peripheral edge thereof on the outer peripheral surface of the shaft 19. It is also possible to merely fit an annular plate member on a part of the shaft 19 in between each end of the needle bearings 20 and the inner side surface of the corresponding support wall portion 17.

However, such consideration is not always necessary in the case of a steel rocker arm (since a steel rocker arm can be formed to be thinner than an aluminum rocker arm and does not always lead to an increase in the inertial mass, it may be used even in a high-speed engine).

As has been described above, it is possible according to the cam follower device of the present invention to perform effective lubrication, surely secure the shaft, achieve a reduction in the load on the needle bearings, lower the noise level and improve the high-speed follow-up performance. Thus, a cam follower device which has satisfactory durability and reliability and is capable of satisfactorily coping with an increase in engine speed is obtained at relatively low cost.

What is claimed is:

1. A cam follower device which is incorporated in a valve driving mechanism of an engine to contact the outer peripheral surface of a cam secured to a cam shaft that rotates synchronously with a crankshaft of said engine, thereby transmitting the motion of said cam to a valve that opens and closes a suction port or an exhaust port in said engine, comprising:

a pair of spaced support wall portions which are formed on a member that is provided in opposing relation to said cam to receive the motion of said cam;

through-holes which are formed in said support wall portions at respective positions that are aligned with each other;

a steel shaft which has been hardened at an intermediate portion thereof, two end portions of said shaft, which are not hardened, being fitted into said through-holes and then staked toward the inner peripheral surfaces of said through-holes where said end portions are disposed, thereby being secured between said pair of support wall portions; and a ceramic outer ring which is rotatably supported through a plurality of hardened steel needle bearings around the intermediate portion of said shaft that is located between said pair of support wall portions, said outer ring being in contact at the outer peripheral surface with the outer peripheral surface of said cam, wherein the size of a clearance which is present where said steel needle bearings are disposed at ordinary temperature is set within the range of from ($5\ \mu m + 9.5 \times 10^{-4}$ Di) to ($18\ \mu m + 9.5 \times 10^{-4}$ Di), where Di is the inner diameter of said outer ring.

2. A cam follower device according to claim 1, wherein the hardness of the intermediate portion of said shaft is within the range of from Hv 640 to Hv 840, the hardness of the two end portions of said shaft is within the range of from Hv 200 to Hv 336, said needle bearings are formed from a bearing steel having a hardness of not less than Hv 650, and said outer ring is formed from a silicon nitride ceramic material which has a hardness of not less than Hv 1000 and a specific gravity of not more than 4.

3. A cam follower device according to claim 1 or 2, wherein said shaft is in the form of a hollow tube.

4. A cam follower device according to claim 1, wherein said support wall portions are formed on an end portion of a rocker arm.

5. A cam follower device according to claim 1, wherein said support wall portions are formed on an intermediate portion of a rocker arm.

6. A cam follower device according to claims 1 or 2, wherein said support wall portions are formed at the proximal end portion of said valve.

7. A cam follower device according to claim 2, wherein said support wall portions are formed on an end portion of a rocker arm.

8. A cam follower device according to claim 2, wherein said support wall portions are formed on an intermediate portion of a rocker arm.

9. A cam follower device according to any one of claims 1, 2, 4, 7 or 8, wherein the end portions of said shaft are non-concentrically staked toward the opening ends of said through-holes.

10. A cam follower device according to claim 6, wherein the end portions of said shaft are non-concentrically staked toward the opening ends of said through-holes.

11. A cam follower device according to any one of claims 1, 2, 4, 7 or 8, wherein the outer peripheral surface of said outer ring has been subjected to crowning.

12. A cam follower device according to claim 6, wherein the outer peripheral surface of said outer ring has been subjected to crowning.

13. A cam follower device according to any one of claims 4 or 7, wherein an annular plate member is provided in between each end of said needle bearings and the inner side surface of each of said pair of support wall portions that are provided on a part of an aluminum rocker arm.

14. A cam follower device according to any one of claims 4, 7, or 8, wherein said rocker arm is made of steel.

15. A cam follower device according to claim 6, wherein said rocker arm is made of steel.

* * * * *